US007507136B2

(12) United States Patent
Patton

(10) Patent No.: US 7,507,136 B2
(45) Date of Patent: Mar. 24, 2009

(54) CONSTRUCTION SET UTILIZING MAGNETS

(76) Inventor: Claire Jean Patton, 284 Blenheim Rd., Columbus, OH (US) 43214

( * ) Notice: Subject to any disclaimer, the term of this patent is extended or adjusted under 35 U.S.C. 154(b) by 208 days.

(21) Appl. No.: 11/635,994

(22) Filed: Dec. 8, 2006

(65) Prior Publication Data

US 2008/0139077 A1 Jun. 12, 2008

(51) Int. Cl.
*A63H 33/04* (2006.01)

(52) U.S. Cl. ..... 446/92; 335/285; 335/295; 335/302; 335/303; 335/304; 335/305; 335/306

(58) Field of Classification Search ..... 335/285, 335/295, 302–306; 446/92
See application file for complete search history.

(56) References Cited

U.S. PATENT DOCUMENTS

| | | | | |
|---|---|---|---|---|
| 2,795,893 | A | 6/1957 | Vayo | |
| 3,090,155 | A * | 5/1963 | Gordon | 446/92 |
| 3,184,882 | A | 5/1965 | Vega | |
| 3,254,440 | A | 6/1966 | Duggar | |
| 3,601,921 | A | 8/1971 | Strohmaier | |
| 3,854,109 | A * | 12/1974 | Gotanda | 335/207 |
| 4,238,905 | A | 12/1980 | MacGraw, II | |
| 5,009,625 | A | 4/1991 | Longuet-Higgins | |
| 5,019,796 | A * | 5/1991 | Lee et al. | 335/302 |
| 5,347,253 | A | 9/1994 | Ogikubo | |
| 5,746,638 | A | 5/1998 | Shiraishi | |
| 6,024,626 | A | 2/2000 | Mendelsohn | |
| 6,421,519 | B1 * | 7/2002 | Yamashita et al. | 399/277 |
| 6,431,936 | B1 | 8/2002 | Kiribuchi | |
| 6,626,727 | B2 * | 9/2003 | Balanchi | 446/85 |
| 6,749,480 | B1 | 6/2004 | Hunts | |
| 7,066,778 | B2 | 6/2006 | Kretzschmar | |
| 7,234,986 | B2 * | 6/2007 | Kowalski et al. | 446/92 |
| 7,322,873 | B2 * | 1/2008 | Rosen et al. | 446/91 |
| 2005/0164595 | A1 | 7/2005 | Toht | |
| 2006/0111010 | A1 | 5/2006 | Park | |
| 2006/0178081 | A1 | 8/2006 | Daftari | |
| 2007/0024405 | A1 * | 2/2007 | Terasaki | 335/302 |
| 2007/0037469 | A1 * | 2/2007 | Yoon | 446/92 |
| 2007/0190892 | A1 * | 8/2007 | Manvelian | 446/92 |
| 2007/0287353 | A1 * | 12/2007 | Vicentelli | 446/92 |

* cited by examiner

*Primary Examiner*—Elvin G Enad
*Assistant Examiner*—Mohamad A Musleh
(74) *Attorney, Agent, or Firm*—Claire J. Patton

(57) ABSTRACT

A set of magnetic blocks by which connection is made between blocks through a force attracting multiple ferrous protrusions on one face to multiple recessed magnets on another face. The multiple points of magnetic connection provide alignment and rigidity to the assembled structure.

10 Claims, 7 Drawing Sheets

CONSTRUCTION SET UTILIZING MAGNETS

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention generally relates to a toy construction set, and specifically to a set of building blocks that connect by magnetic force to each other in both horizontal and vertical directions. The construction set provides the user with a means to build three dimensional structural designs and promotes creativity, education and entertainment.

2. Related Inventions

Previously, other types of construction blocks have been designed to connect magnetically, but none have the advantages in design as stated in the present invention.

There are previous block designs where the connecting faces are smooth and flat, and the connection is made by a single magnet located behind the surface of the face of each block, such as indicated in U.S. Pat. No. 3,601,921.

The first disadvantage of this design is the difficulty involved in achieving a precise alignment of the matching block surfaces. The smooth surface faces are without a guiding means to aid in alignment of the blocks. A guiding means might involve protrusions on the face of one block to match up to recesses on the joining face of another block. Without precise alignment in this block design, the structure constructed lacks stability and visual symmetry.

The second disadvantage of this design is the direct magnet to magnet type of connection. To make this connection, the north polarized side of a magnet connects to the south polarized side of another magnet. Blocks of this design type would require some faces to be north polarized and some to be south polarized. The magnetic polarity of the block face may not be readily apparent to the user by simply looking at each block. Therefore, the user would have to spend time hunting for block faces with opposing polarities, thereby wasting playtime and increasing frustration.

The third disadvantage of a block design where the magnets are located behind the block surface is the impediment provided by the intervening material that separates the two magnet surfaces. The intervening material reduces the attractive force between the two magnets such that the bond between blocks is weaker than if there would be direct contact of the magnets.

The fourth disadvantage of a magnet to magnet connection on smooth faces is the likelihood of unintentional rotation of the blocks along the plane of connection. The connection of a single magnet on one block face to a single magnet on another block face allows the two faces to rotate relative to each other. Similar to the lack of a guiding means, the rotation results in imprecise alignment of the blocks, and the structure becomes less rigid and unstable.

Some construction blocks have been designed with a means to allow the magnets to rotate within the blocks, so that polarity is not an issue: U.S. Pat. Nos. 5,746,638 and 6,749,480; U.S. applications No. 2005/0164595 and No. 2006/0111010. However, these inventions employ various design features which add unnecessary complication and expense to the toy's fabrication. These designs also lack a guiding means to achieve precision in block alignment, and allow for rotation of the blocks along the plane of connection.

There are block designs were the magnets are located only in two parallel opposing faces, whereby the user is restricted to joining blocks magnetically in only one plane, either horizontally or vertically. This design limits the versatility and types of structure that can be assembled with the blocks.

U.S. Pat. No. 6,024,626 is a design for magnetic blocks that uses four points of magnetic connection on each of two parallel opposing faces, and employs a center protrusion with matching recess for positioning and aligning the blocks. The four magnet surfaces are located behind the block face. The design uses magnet to magnet connections which burden the user with searching for opposing polarity of the block faces. The hidden magnet design introduces intervening material that obstructs and reduces the magnetic force available to connect the blocks. In addition, with only two opposing block faces available for connection, the block design restricts the user to either horizontal or vertical connection, and therefore limits the assembly and creative scope of the structure.

There exists a magnetic construction set that uses blocks with a positioning means and larger, more powerful magnets to make magnetic connections to assemble specific structures. While this type of design allows for non-rotation of the blocks and more stable structures, the high level of magnetic force exhibited presents a safety issue when used in the design of children's toys. The high level of force involved presents a means for a child's fingers or skin to become pinched between the blocks during assembly. In this design, the magnets are not adequately attached to their supporting structure. Therefore, larger, more powerful magnets can detach from their recesses, presenting a serious health concern if ingested. Typically, the blocks in such a set also have magnets on only two opposing faces, which present a polarity issue, and restrict construction to only horizontal or vertical directions. In addition, these construction sets are typically designed for assembly of specific structures; therefore, the blocks are not versatile enough to allow for creative reuse in assembly of a variety of structures.

SUMMARY

In accordance with one embodiment, the present design involves a construction set comprising blocks with each face having either a plurality of ferrous protrusions or a plurality of matching recesses including magnets recessed in the bottom. Each construction block is capable of both vertical and horizontal magnetic connection to another block by the attractive force of the recessed magnets to the ferrous protrusions. The present design allows the user to assemble a wide variety of three dimensional structures.

DRAWINGS—FIGURES

DETAILED DESCRIPTION

Figure 1:
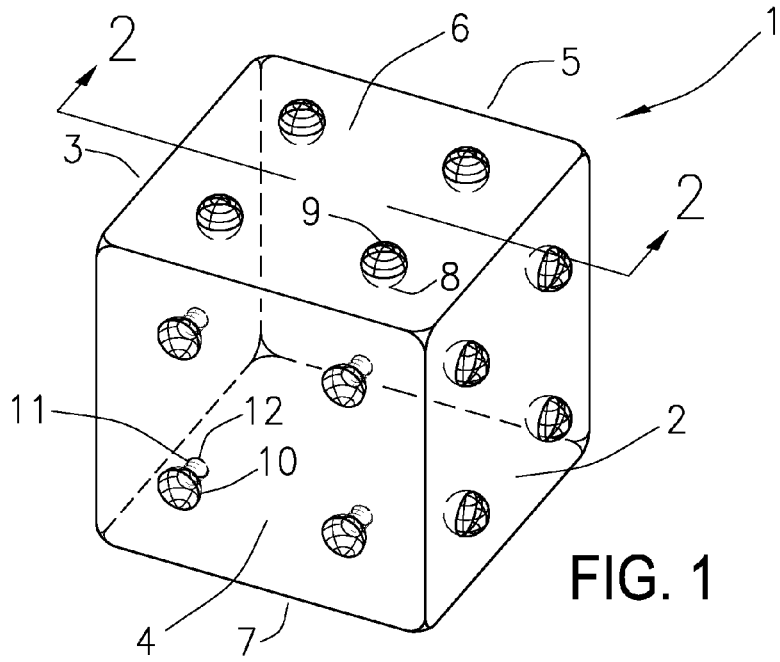
FIG. 1 is a perspective view of the front of a cube shaped block incorporating the design features of a first embodiment of the present invention with spherical protrusions and recesses.
Figure 2:
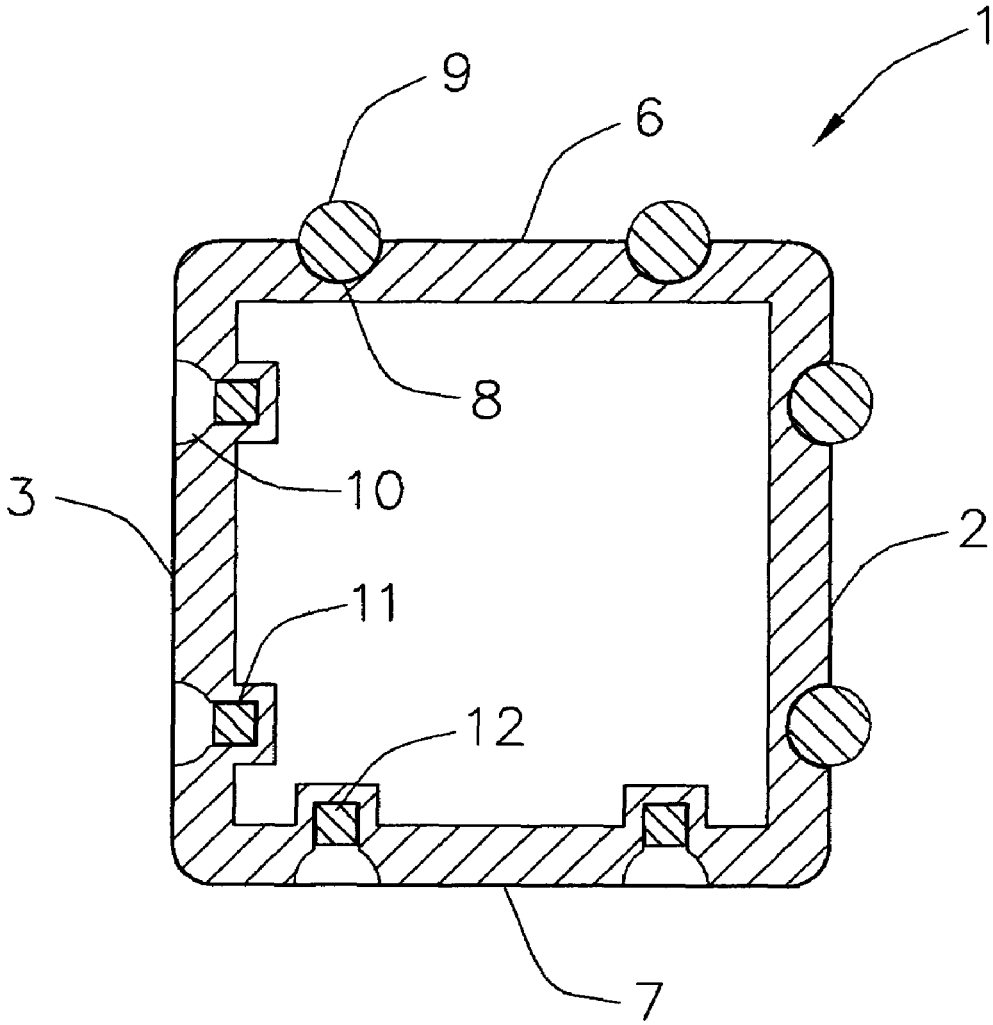
FIG. 2 is a cross-sectional view taken along line 2-2 of FIG. 1.

First Embodiment—FIGS. 1-2

Figure 1B:
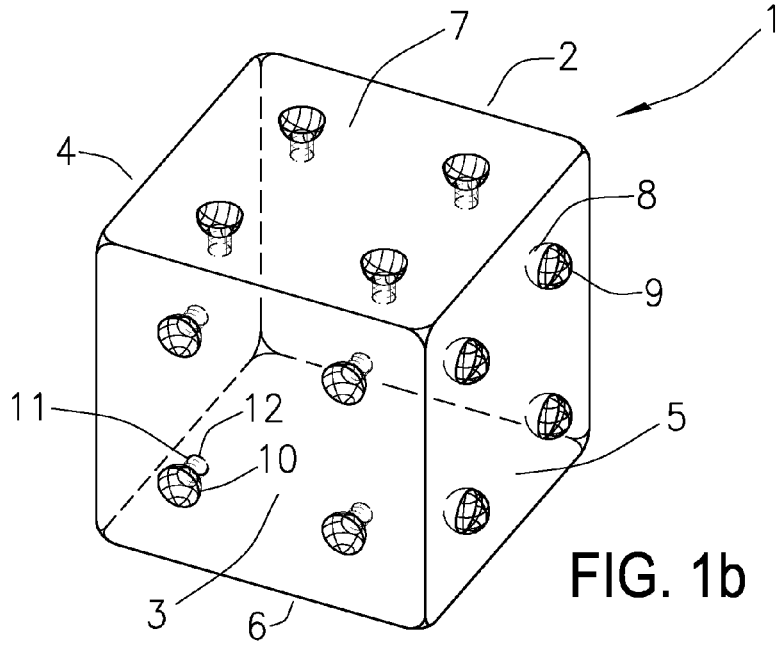
FIG. 1*b* is a perspective view of the back, opposite side of the cube shaped block of FIG. 1, showing the three other faces: 7, 3, and 5.

As shown in FIG. 1, a cube shaped block 1 having parallel front and rear faces 4 and 5, parallel right and left side faces 2 and 3, and parallel upper and lower faces 6 and 7. The block can be mostly hollow, with solid front, rear, side, upper and lower faces, and of a predetermined thickness. The block could be manufactured of plastic or other light weight material that is economical. The corners of the blocks could be slightly rounded so there are no sharp points. The blocks could be of a variety of sizes, preferably with a diameter of at least 1½ inches, so as not to become a choking hazard. Upper face 6 has four equally spaced hemispherical recesses 8. Within each recess 8 is located a ferrous, preferably steel, spherical ball 9. Each ball 9 is recessed halfway into each recess 8, such that the upper half of the ball, (a hemispherical shape), is protruding beyond the face 6, thereby creating a ferrous protrusion. The ball could be secured by glue, epoxy, or adhered by other means to the block face. This type of face with ferrous protrusions is termed a "passive" face. The same passive face described for upper face 6 can be located on right side face 2 (as shown in FIG. 1) and rear face 5 (as shown in FIG. 1*b*; the back, opposite side of block 1). Front surface 4 has four equally spaced hemispherical recesses 10. Recesses 10 are sized and located to match and align with another's block's protrusions on a passive face. Located at the bottom of each recess, 10 is another smaller cylindrical recess 11. Within each recess 11 is located a cylindrical magnet 12. The magnet 12 could be secured by glue, epoxy, or adhered by other means inside the recess 11. This type of face with recessed magnets is termed an "active" face. The same active face described for front face 4 (as shown in FIG. 1) can be located on left side face 3 and lower face 7 both faces as shown in FIG. 1*b*; the back, opposite side of block 1). Therefore, the first embodiment of an element, a cube shaped block with 6 sides, includes 3 passive faces and 3 active faces.

The FIG. 2 indicates a cross-sectional view of the block 1 taken along line 2-2 of FIG. 1. FIG. 2 gives a sectional view of passive faces 6 (upper), 2 (right side); and active faces 3 (left side) and 7 (lower).

OPERATION

First Embodiment—FIGS. 1-2

During the user's process of construction, a block 1 is joined with another block 1 by aligning the passive face of one block that incorporates ferrous protrusions to the active face of another block that incorporates recesses and magnets. The recessed magnets 12 are attracted to the steel balls 9 when the two blocks surfaces are brought together in close proximity. The magnetic attractive force between the ferrous protrusions and the magnets gently pulls and aligns the two block faces together. The magnet blocks can be assembled both side by side horizontally and up and down vertically. The user would continue to connect the system of blocks together to form a three dimensional building, sculpture, or other structure.

DETAILED DESCRIPTION AND OPERATION

Figure 3:
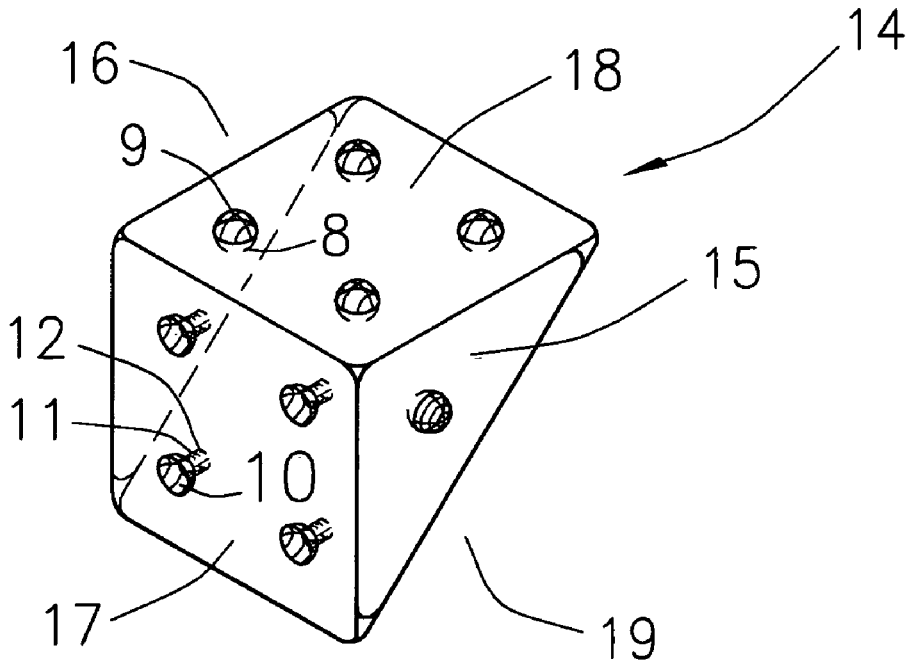
FIG. 3 is a perspective view of a triangular shaped block similar to FIG. 1.

Alternate Embodiment—FIG. 3

The FIG. 3 triangular shaped block 14 has parallel right and left side triangular shaped faces 15 and 16, perpendicular front and upper square shaped faces 17 and 18, and angular rear face 19. Upper face 18 can be a passive type face as described in FIG. 1. The same passive type face can be located on right side face 15, but with a single, central protrusion. Front face 17 can be an active type face. Similar to FIG. 1, recesses 10 on the active face are sized and located to match and align with another's block's protrusions on its passive face. Located at the bottom of each recess 10 is another smaller cylindrical recess 11. Within each recess 11 is located a cylindrical magnet 12. The same active type face can be located on left side face 16, but with a single, central recessed magnet (hidden from view; not shown). Angular surface 19 is presently preferred for this embodiment to be a smooth face with no protrusions or recesses.

The triangular block 14 would function similar to the cube shaped block 1 by aligning the passive face of one block that incorporates ferrous protrusions to the active face of another block that incorporates recesses and magnets. The square faces 17 and 18 can be connected to other square faces, and the triangular side faces 15 and 16 can be connected to other side faces. The triangular shape adds to the variety of structures that can be assembled.

Figure 4:
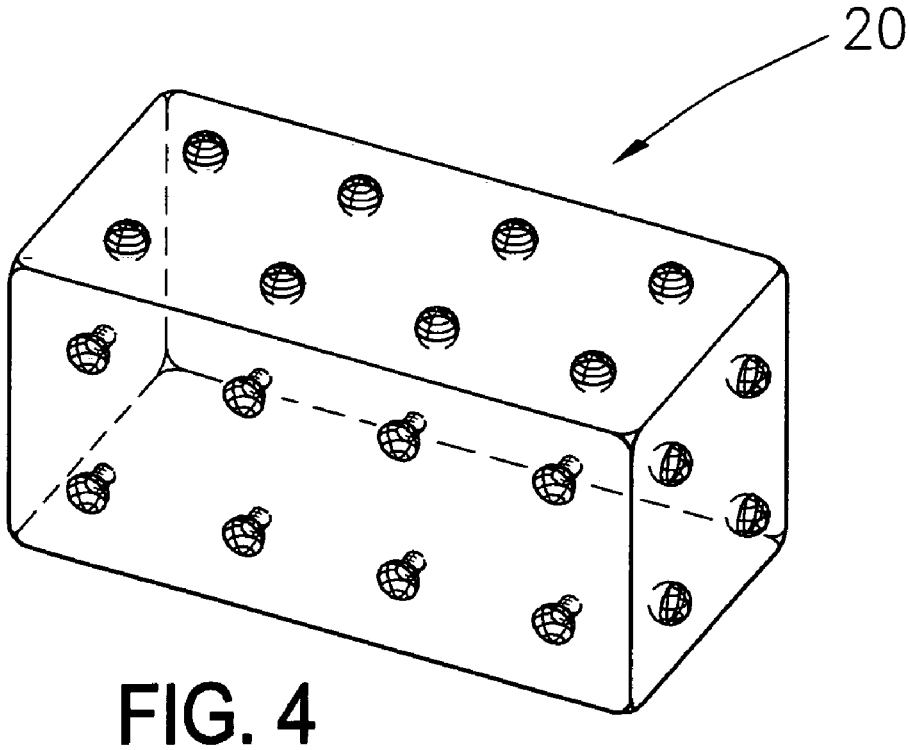
FIG. 4 is a perspective view of a rectilinear shaped block similar to FIG. 1.

Alternate Embodiment—FIG. 4

The FIG. 4 rectangular shaped block 20 has twice the length of cube shaped block 1, and functions basically as two block 1 elements side by side, with eight connection points on the upper, lower, front and rear faces; and four connection points on the side faces.

Figure 5:
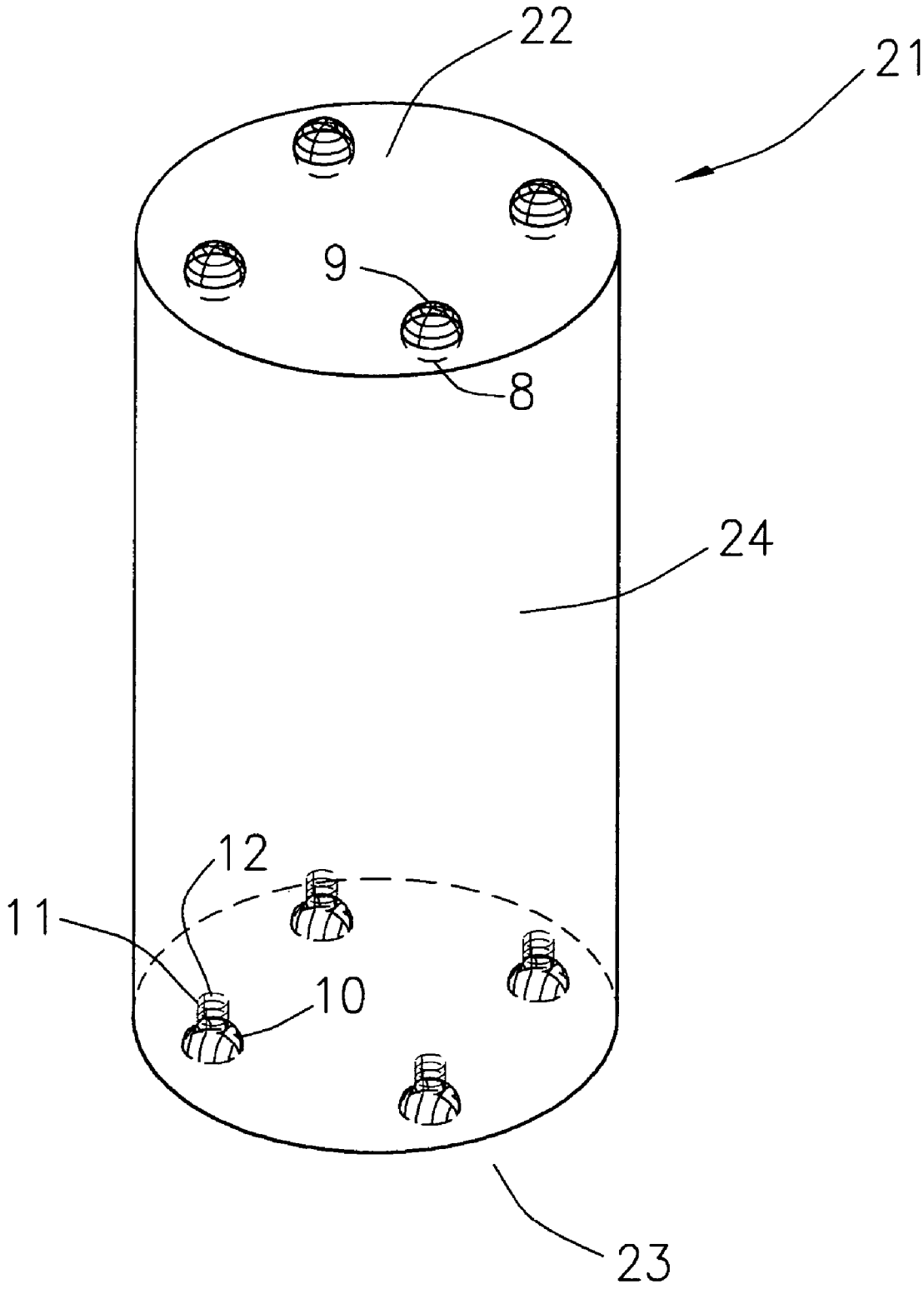
FIG. 5 is a perspective view of a cylindrical shaped block similar to FIG. 1.

Alternate Embodiment—FIG. 5

The FIG. 5 cylindrical shaped block 21 has an upper circular face 22 and parallel lower circular face 23. Perpendicular and attached to faces 22 and 23 is a cylindrical face 24. Upper face 22 can be a passive type face. Each ball 9 is recessed halfway into each recess 8, such that half of the ball is protruding beyond the face 22. Lower face 23 can be an active type face, (shown in hidden view). Recesses 10 are sized and located to match and align with another's block's ferrous steel balls 9. Located at the bottom of each recess 10 is another smaller cylindrical recess 11. Within each recess 11 is located a cylindrical magnet 12.

The cylindrical block 21 would function similar to the cube shaped block 1, but the embodiment would have two surfaces available for connection, instead of six. The cylindrical shape adds to the variety of structures that can be assembled.

Figure 6:
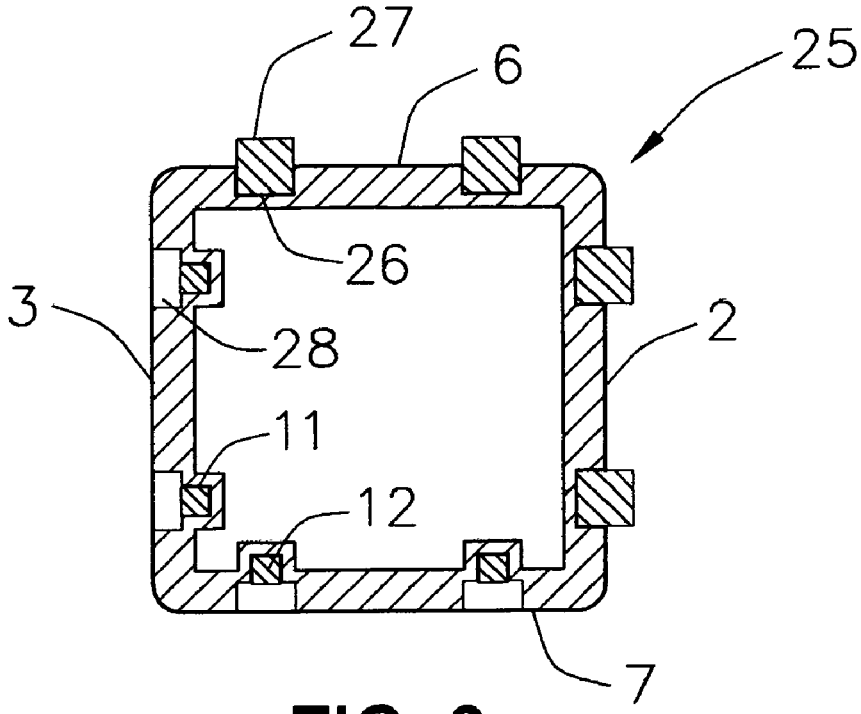
FIG. 6 is a cross-sectional view similar to FIG. 2, of an alternate embodiment using cylindrical shaped protrusions and recesses.

Alternate Embodiment—FIG. 6

The FIG. 6 indicates cube shaped block 25 similar to block 1, with block 25 alternatively including in upper face 6 cylindrical shaped recesses 26, cylindrical shaped ferrous, preferably steel, protrusions 27, with each protrusion 27 recessed into each recess 26, such that some predetermined length of the cylinder is protruding beyond the face 6. Face 6 would be a passive type face. Side face 3 has four equally spaced cylindrical recesses 28. Recesses 28 are sized and located to match and align with another's block's protrusions on a passive face. Located at the bottom of each recess 28 is another smaller cylindrical recess 11. Within each recess 11 is located a cylindrical magnet 12. Side face 3 would be an active type face. The cube shaped block 25 would function similar to the cube shaped block 1.

Figure 7:
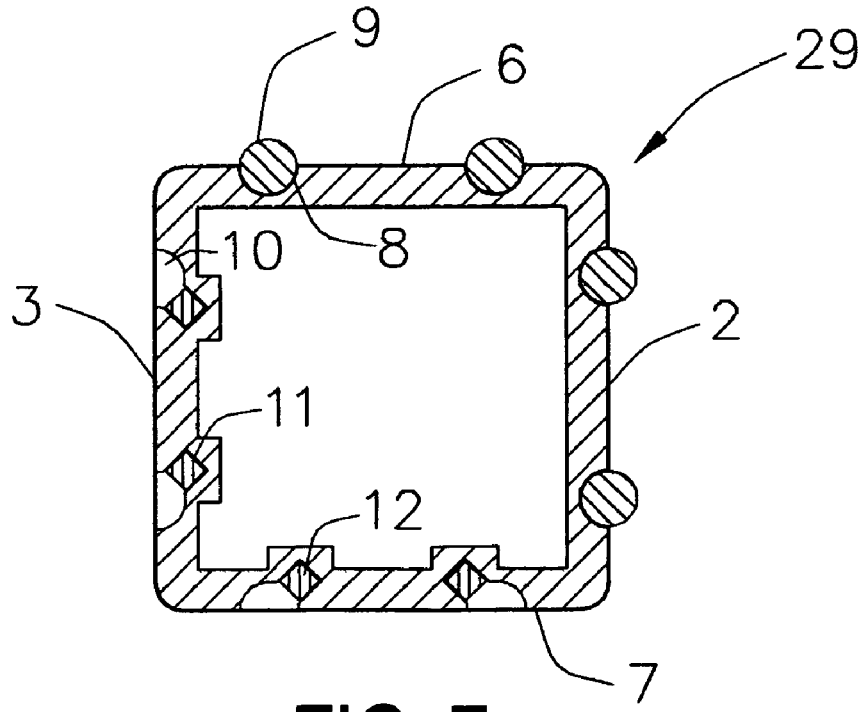
FIG. 7 is a sectional view of a cube shaped block incorporating the design features of a second embodiment of the present invention, showing an alternate magnet location inside the recesses.

Second Embodiment—FIG. 7

FIG. 7 is a sectional view of a cube shaped block 29 incorporating the design features of a second embodiment, showing an alternate magnet location. Block 29 includes the same passive type of faces as block 1. There are included active type faces similar to block 1, but the smaller cylindrical recesses 11 and magnets 12 are located alternatively at the side of each recess 10. This alternative angled position of the magnet 12 would provide that some portion of the block material would act as a means of support for the magnet. The material would act to resist the force reacting on the magnet when the ferrous protrusions of a passive face are withdrawn during disassembly of the blocks. The magnet 12 could be secured by glue, epoxy, or adhered by other means inside the recess 11. The cube shaped block 29 would function similar to the cube shaped block 1.

Figure 8:
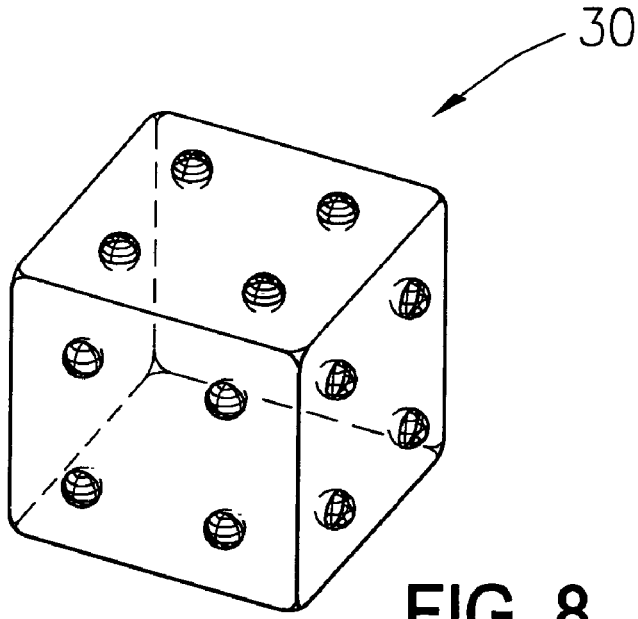
FIG. 8 is a perspective view of a cube shaped block of the passive type, incorporating the design features of a third embodiment of the present invention.
Figure 9:
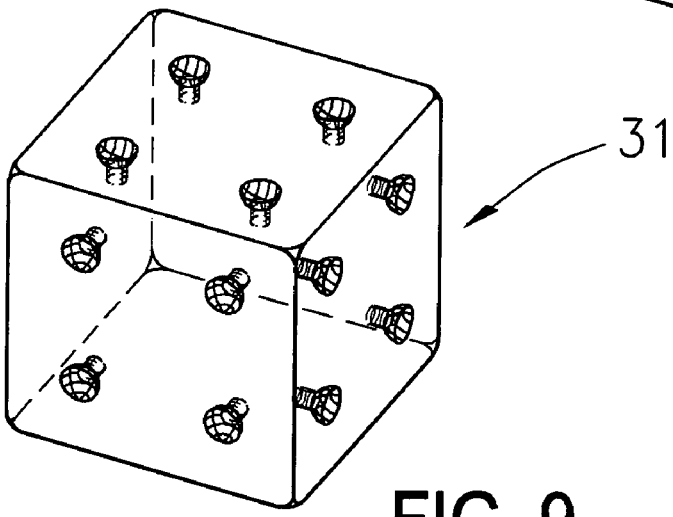
FIG. 9 is a perspective view of a cube shaped block of the active type, incorporating the design features of a third embodiment of the present invention.

Third Embodiment—FIGS. 8 & 9

The FIG. 8 indicates cube shaped block 30 similar to block 1, with block 30 alternatively including only passive type faces with protrusions. The FIG. 9 indicates cube shaped block 31, similar to block 1, with block 31 alternatively including only active type faces with recesses. During the user's process of construction, a passive face of a block 30 is joined with an active face of a block 31 by aligning the ferrous protrusions to the matching recesses with magnets.

DETAILED DESCRIPTION

Figure 10:
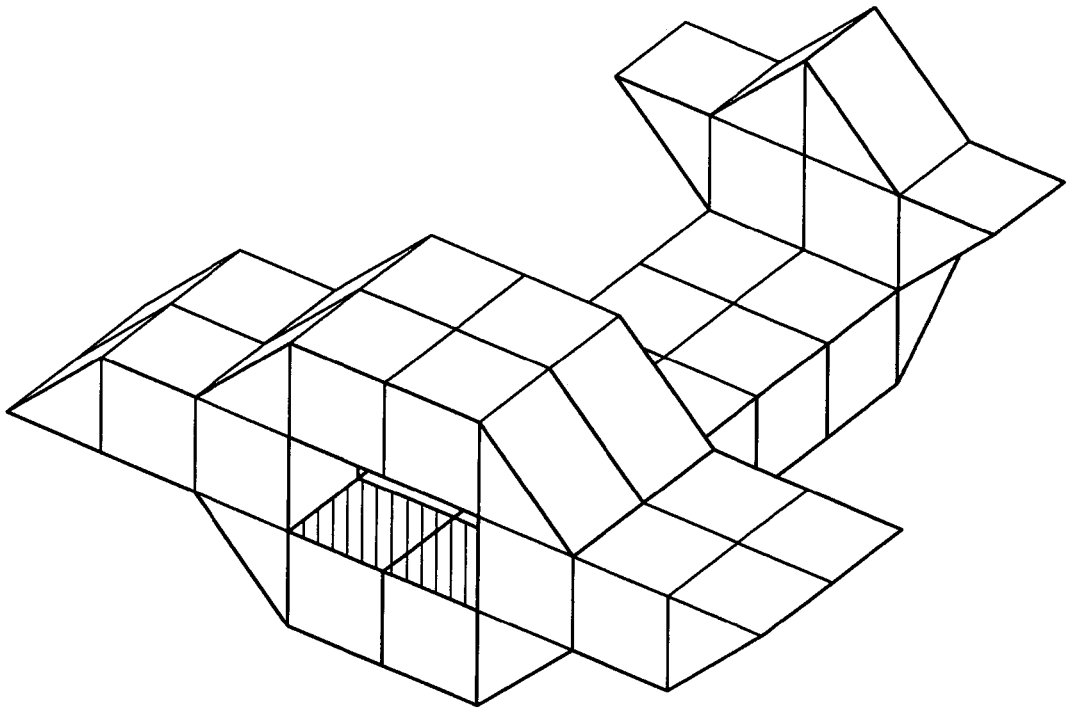
FIG. 10 is a perspective view of a plurality of magnetic blocks of FIG. 1 and FIG. 3 constructed into an assembled structure.

Assembled Elements—FIG. 10

FIG. 10 is a structure constructed of a plurality of magnetic blocks of the cube and triangular shapes. The protrusions and recesses on the faces of the blocks are not shown in the drawing for simplicity. The configuration of the blocks can be varied to enable assembly of a wide variety of structures.

ADVANTAGES

In the first embodiment, magnetic connection is made between the ferrous protrusions on one block's face to the recessed magnets on another block's face, thus eliminating the polarity issue intrinsic to a magnet to magnet connection. The user can readily see to align the protrusions to the recesses when assembling the blocks.

In the first embodiment, the blocks would use four points of magnetic connection on each face, made by ferrous protrusions on one face joining with the matching recesses with magnets on the other block's face. These protrusions and recesses would act as an alignment tool in the initial assembly of the blocks, and the four points of connection would provide rigidity to the connected blocks to resist rotation of the blocks about the plane of the connected faces.

In the first embodiment, the blocks have points of connection available on all faces, thus enabling the user to assemble the blocks in both the horizontal and vertical directions, to create more complex and fascinating structures.

In the first embodiment, the blocks' ferrous protrusions and matching recesses are spherical. The spherical shapes would prove easier for a young child to align during assembly rather than cylindrical or cubical shapes. The structures would also be easier to disassemble as the user could disengage the magnetic force by slight rotation of the joined blocks perpendicular to the plane of connection.

CONCLUSION, RAMIFICATIONS, AND SCOPE

Therefore, the reader will see that according to one embodiment of the invention, I have provided an easy to use set of magnetic construction blocks that enable the user to assemble a variety of more interesting and stable structures.

While the above description contains many specificities, these should not be construed as limitations on the scope of any embodiment, but as exemplifications of the presently preferred embodiments thereof. Many other ramifications and variations are possible within the teachings of the various embodiments. For example, the polyhedral shaped block elements could be made in a multitude of various sizes, colors, and three dimensional geometric shapes, including curves or arches. The faces of the blocks could be not only flat surfaces, but curved, or having other geometric characteristics. The blocks could be made of various lightweight materials. Various layouts and quantities of the protrusions and recesses could be used in the design, and faces could be such that one or more faces are made without protrusions or recessed magnets.

Various styles, sizes, materials, and shapes of protrusions and recessed magnets could be used in the design. The recessed magnets could be made wider in diameter, but with the same exposed surface area available to contact the protrusions as indicated in the drawings. This design would enable more of the block material to be available to act as a means of support for the magnet. The block material would act to resist the force reacting on the magnet when the ferrous protrusions of a passive face are withdrawn during disassembly of the blocks. This design would help prevent the magnets from detaching from their recesses. There could also be an alternate means of non-rotational magnetic connection between the blocks, such as a single, central cross, or an "x" shaped protrusion with ferrous central core connecting to a single, central cross, or an "x" shaped recess with a centrally recessed magnet.

Thus, the scope of the invention should be determined by the appended claims and their legal equivalents, and not by the examples given.

I claim:

1. A construction set comprising: a plurality of elements having polyhedral shape, each of said elements comprising:

(a) a plurality of faces comprised of passive and active faces; and (b) said passive face includes a plurality of equally spaced ferrous protrusions disposed and permanently secured on the surface of said passive face, and (c) said active face includes a plurality of equally spaced first recesses disposed on the surface of said active face, the bottom center of each said first recess including:

(d) a magnet of polyhedral shape disposed and permanently secured in a second recess thereof, the magnet including an upper surface face, and said upper surface face positioned exposed in said first recess, whereby an element's passive face can be joined to another element's active face, wherein said ferrous protrusions of said passive face are thereby joined by magnetic force to said magnets recessed in said active face.

2. The construction set of claim 1, wherein said elements are cubical in shape.

3. The construction set of claim 1, wherein said elements are triangular in shape.

4. The construction set of claim 1, wherein said elements are rectilinear in shape.

5. The construction set of claim 1, wherein said elements are cylindrical in shape.

6. The construction set of claim 1, wherein said ferrous protrusions are hemispherical in shape, and said first recesses are hemispherical in shape.

7. The construction set of claim 1, wherein said ferrous protrusions are cylindrical in shape, and said first recesses are cylindrical in shape.

8. The construction set of claim 1, wherein said magnet is cylindrical in shape.

9. A construction set comprising: a plurality of elements having polyhedral shape, each of said elements comprising:

(a) a plurality of faces comprised of passive and active faces; and (b) said passive face includes a plurality of equally spaced ferrous protrusions disposed and permanently secured on the surface of said passive face, and (c) said active face includes a plurality of equally spaced first recesses disposed on the surface of said active face, the side surface of each said first recess including:

(d) a magnet of polyhedral shape disposed and permanently secured in a second recess thereof, the magnet including an upper surface face, and said upper surface face positioned exposed in said first recess, whereby an element's passive face can be joined to another element's active face, wherein said ferrous protrusions of said passive face are thereby joined by magnetic force to said magnets recessed in said active face.

10. A construction set comprising: a plurality of passive and active elements having polyhedral shape, (a) the passive element comprising:

a plurality of passive faces wherein a plurality of equally spaced ferrous protrusions are disposed and permanently secured on the surface of each said passive face, and (b) the active element comprising:

a plurality of active faces wherein a plurality of equally spaced first recesses are disposed on the surface of each said active face, the bottom center of each said first recess including:

(c) a magnet of polyhedral shape disposed and permanently secured in a second recess thereof, the magnet including an upper surface face, and said upper surface face positioned exposed in said first recess, whereby a passive element's passive face can be joined to an active element's active face, wherein said ferrous protrusions of said passive face are thereby joined by magnetic force to said magnets recessed in said active face.

* * * * *